United States Patent [19]

Walker

[11] 4,004,730

[45] Jan. 25, 1977

[54] FURNACE DRAFT CONTROL FOR A STEAM GENERATOR

[75] Inventor: Robert R. Walker, Euclid, Ohio

[73] Assignee: Bailey Meter Company, Wickliffe, Ohio

[22] Filed: Sept. 22, 1975

[21] Appl. No.: 615,329

[52] U.S. Cl. ..... 236/14; 236/15 C; 110/72 B

[51] Int. Cl.[2] ..... F23N 3/08

[58] Field of Search ..... 236/15 B, 15 C, 14; 110/72 B; 417/5, 36, 38; 98/1.5

[56] References Cited

UNITED STATES PATENTS

| | | | |
|---|---|---|---|
| 1,455,860 | 5/1923 | Brown | 236/15 C |
| 1,905,745 | 4/1933 | Peebles | 236/14 |
| 2,105,686 | 1/1938 | Cunningham | 236/15 C X |
| 2,160,968 | 6/1939 | Hagen | 236/15 C UX |
| 2,217,518 | 10/1940 | Merkt | 236/15 C X |

*Primary Examiner*—William E. Wayner
*Attorney, Agent, or Firm*—J. M. Maguire; John F. Luhrs

[57] ABSTRACT

A furnace draft control for a fossil fuel fired steam generator wherein the rates of flow of fuel, air and flue gas are adjusted in parallel in accordance with changes in power demand and the forced and induced drafts are adjusted in opposite directions as required to maintain furnace draft at set point.

8 Claims, 1 Drawing Figure

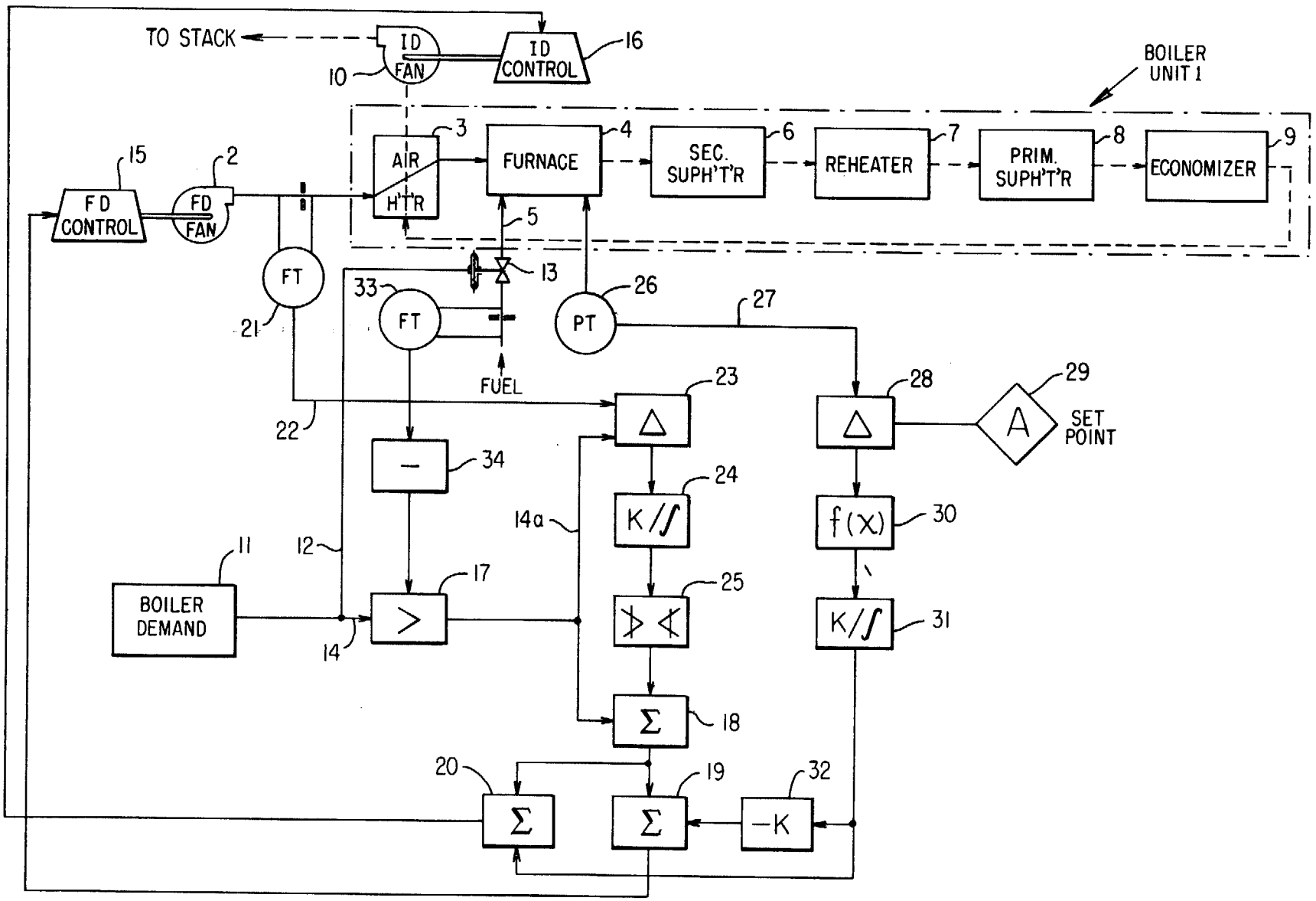
BOILER UNIT 1
ECONOMIZER
PRIM. SUPH'T'R
REHEATER
SEC. SUPH'T'R
FURNACE
AIR H'T'R
ID CONTROL
ID FAN
FD FAN
FD CONTROL
TO STACK
FUEL
PT
FT
FT
SET POINT
BOILER DEMAND
f(X)
K/∫
-K
Σ
Σ
Σ
Δ
Δ
K/∫
>
-
1
2
3
4
5
6
7
8
9
10
11
12
13
14
14a
15
16
17
18
19
20
21
22
23
24
25
26
27
28
29
30
31
32
33
34

FURNACE DRAFT CONTROL FOR A STEAM GENERATOR

This invention relates to a furnace draft control for fossil fuel fired steam generators and more particularly to a furnace draft control for large size steam generators such as found in modern central stations. As an order of magnitude such generators may, for example, be rated at upwards of 6,000,000 pounds of steam per hour at 2,500 psig and 1,000° F.

In accordance with the invention the rates of flow of fuel and air to the furnace of the generator and the rate of flow of flue gas exhausted from the furnace are adjusted in parallel in functional relation to changes in generator output demand to thereby maintain, to a first approximation, throughout the load range of the generator, furnace draft at set point; with the forced and induced drafts being continuously adjusted in opposite directions as required to maintain the furnace draft at set point.

This and further objectives of the invention will be apparent as the description proceeds in connection with the drawing which is a schematic of the air-gas cycle of a typical fossil fuel fired steam generator and a logic diagram of a furnace draft control for the generator embodying the invention.

Referring to the drawing is shown the air-gas cycle for a typical steam generator, or boiler, as it is sometimes called, generally indicated at 1. Air for combustion, supplied by a forced draft fan 2, passes through an air heater 3 and is discharged into a furnace 4. Fuel, which may be oil, gas, coal, or a combination thereof, is discharged into the furnace 4 from any conventional means, not shown, but diagramatically represented by a fuel line 5. The gases of combustion, or flue gas as it is commonly called, leaving furnace 4, pass through secondary superheater 6, reheater 7, primary superheater 8, economizer 9, air heater 3, and induced draft fan 10, whence they are discharged to the atmosphere through a stack (not shown).

In reference to the furnace draft control shown in the drawing and embodying a specific form of the invention it should be noted that conventional control logic symbols have been used. The control components, or hardware, as it is sometimes called, which such symbols represent, are commercially available and their operation well understood in the art. Furthermore, conventional logic symbols have been used to avoid identification of the control with a particular type, such as pneumatic, hydraulic, electronic, electric, digital, or a combination of these, as the invention may be incorporated in any one.

In the embodiment of the invention shown in the drawing the rates of flow of air, fuel and flue gas are adjusted in parallel from a boiler demand signal, derived from any conventional source, such as a load dispatch system, steam pressure or the like, but for purposes of illustration shown as originating in a signal generator 11, which is transmitted over a conductor 12 to a fuel control means, such as a valve 13, and over a conductor 14, through various signal modifying components, to a forced draft controller 15, and an induced draft controller 16. As shown, controllers 15 and 16 adjust the forced draft and induced draft by changing the speed of fans 2 and 10 respectively, however, one or the other or both controllers may adjust draft by means of a damper operated in parallel with fan speed or by means of a damper alone, the particular arrangement used forming no part of the present invention.

The demand signal, generated in unit 11, establishes the rates of air and fuel flow required to satisfy the then existing generator output demand. A change in this signal, transmitted over conductor 14, through summing units 18 and 19, effects an immediate and corresponding change in speed of the forced draft fan 2 which, to a first approximation, effects the required change in air flow. To precisely maintain the actual rate of air flow equal to the demand rate a local feedback loop is provided. As shown, the demand signal is transmitted over a conductor **14*a* to a difference unit 23, also receiving a signal proportional to the actual rate of air flow generated in a flow controller 21. The output signal from difference unit 23, as modified in a proportional plus integral unit 24, serves to modify the output signal from summing unit 18 as required to maintain the actual rate of air flow equal to the demand rate of air flow. If required, a max-min limiter such as shown at 25 may be incorporated between units 24 and 18 to inhibit the output signal from difference unit 23** exceeding predetermined limits.

Concurrently with the change in rate of air flow a corresponding change is made in the rate of fuel flow by the signal generated in unit 11, transmitted over conductor 12 operating fuel valve 13. As evident to those familiar with the art, if required, a local feedback loop responsive to fuel flow, similar to that described with reference to the air flow control, may be provided to assure that the actual rate of fuel flow is maintained equal to the demand rate of fuel flow; however, the valve 13 may usually be characterized to maintain the proper ratio between demand signal and rate of fuel flow without such a fuel flow tie-back.

Concurrently with the change in rate of air flow a corresponding change is made in the rate of flow of flue gas by the output signal from summing unit 18, transmitted through summing unit 20 operating induced draft controller 16. As common in the art, the controller 16 may be characterized so that the change in the rate of flue gas flow is so matched with the change in the rate of air flow that, to a first approximation, the draft in furnace 4 is maintained at set point throughout the load range of the generator and regardless of the rate of change in load.

Ordinarily a negative pressure with respect to ambient pressure is maintained within the furnace of a typical steam generator, however, to meet the exigencies of a particular application or the characteristics of a steam generator it may be necessary to maintain a positive furnace pressure with respect to ambient. To avoid possible confusion as to the precise meaning of, for example, — an increase in furnace draft — hereafter and throughout the claims the designation — furnace pressure — has been used; an increase in furnace pressure meaning an increase in pressure with respect to ambient pressure and vice versa.

The control so far described establishes an actual rate of air flow to the furnace equal to the demand rate and concurrently establishes the rate at which flue gas is exhausted from the furnace required to maintain furnace pressure as heretofore stated at, to a first approximation, set point. The invention further comprehends, minimizing deviations from furnace pressure set point by superimposing on this control simultaneous adjustments to the forced and induced drafts, in opposite directions, in response to excursions in furnace pressure from set point.

A pressure controller 26 generates a signal corresponding to furnace pressure which is transmitted through conductor 27 to a difference unit 28 wherein it is compared with a signal corresponding to set point furnace pressure generated in a manually adjustable signal generator 29. The error signal from difference unit 28 inputs to a function generator 30, the output signal therefrom inputing to a proportional plus integral unit 31. The function generator 30 provides a means for establishing, if required, a non-linear relationship between the amount of deviation in furnace pressure from set point and the correction made to the induced and forced drafts. The proportional plus integral unit 31 affords a means for obtaining an adjustable immediate correction to the forced and induced drafts proportional to changes in furnace pressure and a relatively slow continuing correction until furnace pressure is restored to set point. The output signal from unit 31 is transmitted directly to summing unit 20 and through an inverse proportional unit 32 to summing unit 19. In operation, upon a decrease in furnace pressure, the induced draft is decreased and concurrently therewith the forced draft is increased, followed by a continuing change at a rate and sense dependent upon the amount and sense of departure of furnace pressure from set point.

High signal selector 17 selects the higher of the signals generated in unit 11 and in fuel flow transmitter 33, as negatively biased in bias unit 34, thereby providing an overriding control preventing the rate of air flow to the furnace decreasing, relative to the rate of fuel flow, sufficient to cause a deficiency of air for combustion.

In summary, the invention comprehends an actual rate of air flow to the furnace being maintained equal to the demand rate, concurrently establishing a rate at which flue gas is exhausted from the furnace required to maintain furnace pressure at approximately set point and adjusting forced draft and induced draft in opposite directions as required to maintain furnace pressure at set point with a minimum of disturbance to the actual rate of air flow to the furnace.

It is apparent that the control system illustrated and described is by way of example only and that various modifications can be made within the scope of the invention as defined in the appended claims.

I claim:

1. A furnace draft control for a steam generator having a furnace, fuel supply means, forced draft supply means, and induced draft supply means, in combination, means generating a first control signal proportional to furnace pressure and means under the control of said signal increasing the forced draft and simultaneously decreasing the induced draft in functional relationship to a decrease in furnace pressure and vice versa.

2. The combination according to claim 1 further including means responsive to said first control signal increasing said forced draft and simultaneously decreasing said induced draft in functional relationship to the time integral of the amount the furnace pressure is below set point and vice versa.

3. The combination according to claim 2 further including means responsive to the rate of air flow to the furnace modifying said first control signal to decrease the forced draft and simultaneously increase the induced draft in functional relationship to an increase in the rate of air flow and vice versa.

4. The combination according to claim 1 further including means modifying said first control signal to simultaneously increase the forced and induced drafts in proportion to an increase in demand for generator output and vice versa.

5. The combination according to claim 4 further including means increasing the rate of flow of fuel to the furnace in proportion to increases in demand for generator output.

6. The combination according to claim 5 further including means inhibiting the rate of air flow to the furnace decreasing below a predetermined limit for the then existing rate of fuel flow.

7. The combination according to claim 3 further including means generating a second control signal proportional to the demand for generator output, means generating a third control signal proportional to the rate of air flow to the furnace and means modifying said first control signal in accordance with the time integral of the difference between said first and second control signals.

8. The combination according to claim 2 further including means limiting the rate of air flow to the furnace from exceeding predetermined maximum and minimum limits.

* * * * *

PO-1050
(5/69)

UNITED STATES PATENT OFFICE
CERTIFICATE OF CORRECTION

Patent No. 4,004,730 Dated January 25, 1977

Inventor(s) ROBERT R. WALKER

It is certified that error appears in the above-identified patent and that said Letters Patent are hereby corrected as shown below:

Column 1, line 27, after "drawing" insert - there - .

Claim 7, line 7, cancel "first" and insert - third - .

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*